US007942980B2

(12) United States Patent
Maier et al.

(10) Patent No.: US 7,942,980 B2
(45) Date of Patent: May 17, 2011

(54) STARCH REMOVAL PROCESS

(75) Inventors: Helmut Maier, Minneapolis, MN (US); Tomoaki Nakasone, Tokyo (JP)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 11/351,332

(22) Filed: Feb. 9, 2006

(65) Prior Publication Data

US 2007/0181161 A1 Aug. 9, 2007

(51) Int. Cl.
*B08B 3/04* (2006.01)

(52) U.S. Cl. ..... 134/26; 134/2; 134/3; 134/25.2; 134/28; 134/29; 134/36; 134/41; 134/42; 510/111

(58) Field of Classification Search ..... 134/2, 3, 134/25.2, 26, 28, 29, 36, 41, 42; 510/111
See application file for complete search history.

(56) References Cited

U.S. PATENT DOCUMENTS

| | | | | |
|---|---|---|---|---|
| 2,746,466 | A * | 5/1956 | Clague et al. | 134/72 |
| 2,981,265 | A * | 4/1961 | Robson et al. | 134/57 D |
| 3,014,488 | A * | 12/1961 | Seaman | 134/46 |
| 3,789,860 | A * | 2/1974 | Katterheinrich et al. | 165/47 |
| 3,965,914 | A * | 6/1976 | Walker, Jr. | 134/104.4 |
| 4,814,193 | A * | 3/1989 | Shenouda et al. | 426/321 |
| 5,218,980 | A * | 6/1993 | Evans | 134/68 |
| 5,704,380 | A | 1/1998 | Zelniker et al. | |
| 5,879,469 | A * | 3/1999 | Avram | 134/25.2 |
| 5,927,309 | A * | 7/1999 | Hoover et al. | 134/195 |
| 5,947,135 | A * | 9/1999 | Sumida et al. | 134/95.3 |
| 6,694,989 | B2 * | 2/2004 | Everson et al. | 134/25.2 |
| 2002/0065205 | A1 * | 5/2002 | Neplenbroek et al. | 510/220 |
| 2002/0163285 | A1 * | 11/2002 | Vanlandingham | 312/311 |
| 2003/0008794 | A1 | 1/2003 | Jaynes | |
| 2004/0094185 | A1 * | 5/2004 | Fransson | 134/25.2 |
| 2004/0173244 | A1 * | 9/2004 | Strothoff et al. | 134/25.2 |
| 2004/0194810 | A1 * | 10/2004 | Strothoff et al. | 134/25.2 |
| 2006/0042665 | A1 * | 3/2006 | Fernholz et al. | 134/42 |
| 2006/0046945 | A1 * | 3/2006 | Herdt et al. | 510/234 |

FOREIGN PATENT DOCUMENTS

WO WO 02/100993 A1 12/2002

OTHER PUBLICATIONS

Merriam Webster's Collegiate Dictionary, 10th Edition, 1994, p. 1172.*

* cited by examiner

*Primary Examiner* — Sharidan Carrillo
(74) *Attorney, Agent, or Firm* — Andrew D. Sorensen; Laura C. DiLorenzo

(57) ABSTRACT

Starch is removed from the surface of an article using a multi-step method that includes presoaking the article in an acidic solution to remove the starch from the surface of the article and washing the article in an alkaline solution to clean the article.

7 Claims, 1 Drawing Sheet

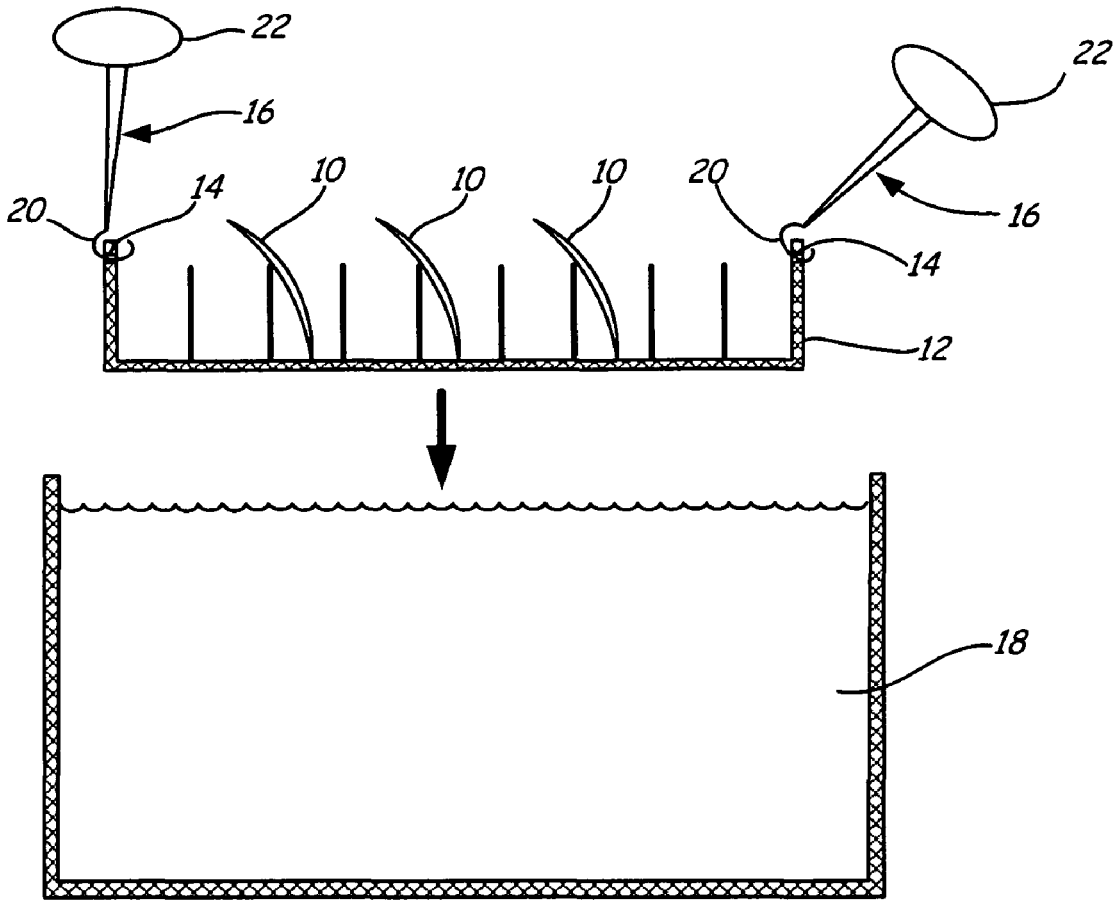
22
16
20
14
10
10
10
20
22
16
14
12
18

STARCH REMOVAL PROCESS

FIELD OF THE INVENTION

The present invention relates to a method of removing starch. In particular, the present invention relates to a method of removing starch from the surface of eating ware.

BACKGROUND OF THE INVENTION

Starchy soils are known to accumulate on eating ware, including, for example, eating utensils, plates, pots, pans, glassware, and the like. Such soils are difficult to remove using conventional warewashing detergents and methods. Starch becomes even more difficult to remove if allowed to remain on the eating ware for an extended period of time, or if the eating ware is exposed to high temperatures. In both cases, the starchy soils are allowed to dry and adhere to the surface and within crevices of the eating ware. In particular, eating ware made of materials such as Melamine is especially subject to forming scratches and cracks where starchy soils may deposit. Thus, cleansing the eating ware in a normal warewashing process may not fully remove the starch deposited on the eating ware. If the starchy soils are not removed during washing, layers of starch deposits may accumulate on the eating ware, making it continually more difficult to remove the starchy soils and resulting in unsightly and potentially unsanitary eating ware.

Previous methods of removing starchy soils and starch build-up include subjecting the eating ware to process cleaning or manual scrubbing. Process cleaning involves occasionally applying a cleaning detergent having a substantially higher concentration of cleaning composition than a typical cleaning detergent to the eating ware. Manual scrubbing requires a person physically scrubbing the starch deposits from the surface and cracks of the eating ware. Both the process cleaning and manual scrubbing are costly and time-consuming. A more current method of removing starch during washing is by using an alkaline-acid-alkaline washing process. The eating ware is first subjected to an alkaline wash, then to an acid wash, and a final alkaline wash. Additional steps may be added to the process to improve the quality of cleaning. Another method is pre-soaking the eating ware in a pre-soak solution containing alkaline detergents. One problem with an alkaline presoak step is that current practice requires individual immersion and removal of the eating ware into and from the presoak solution, necessitating repeated handling of the eating ware and contact with the presoak solution. The eating ware is then racked up into a dishwashing rack for the acid wash and the final alkaline wash.

BRIEF SUMMARY OF THE INVENTION

The method of the present invention removes starch from the surface of an article. The method includes presoaking the article in an acidic solution to remove the starch from the surface of the article and then washing the article in a warewashing process.

BRIEF DESCRIPTION OF THE DRAWINGS

The sole FIGURE is a schematic diagram of a warewashing rack in use with a presoak solution.

DETAILED DESCRIPTION

A method for removing starch involves presoaking starch-soiled articles in an acidic solution and subsequently cleansing the articles in a normal warewashing process. The method may be employed in any of a wide variety of processes where it is desired to remove starchy soils from a surface. The method is especially useful for removing starchy soils from eating ware that may contain scratches and crevices where starch may deposit and is difficult to remove. In addition, the method does not require continuous supervision or a substantial amount of time to be effective. Such articles that can be cleansed by the method include, but are not limited to: melamine ware, ceramic ware, metal ware such as bakery trays, and equipment in food and beverage plants.

The first step of the method involves presoaking the starch-soiled articles in an acidic solution. The starch-soiled articles are presoaked in an acidic solution for a period of time to degrade and remove the starch deposits without scrubbing. The acidic solution is typically supplied as a concentrate and diluted with water prior to application. Once the articles have been presoaked in the acidic solution, the articles are cleansed in a warewashing process known in the art, including automatic and manual dishwashing processes. The warewashing process typically includes using an alkaline solution.

The acidic solution should be aggressive enough to remove the starchy soils from the articles, but not so strong as to be corrosive to the article. Examples of suitable acids are any acids that form an aqueous solution with a pH of between approximately 0 and 4. However, human safety concerns and corrosion of the articles are factors to be taken into consideration. At pH levels below approximately 1, the solution is very acidic and will be corrosive to unprotected skin. In addition, articles such as metal flatware are subject to corrosion if exposed to strong acids for an extended period of time. Conversely, at pH levels above approximately 4, the acidic solution is not as effective for degrading and removing starchy soils. Therefore, the acidic solution used to presoak the starch-soiled articles should typically have a pH between approximately 1 and approximately 4.

The articles are typically presoaked in the acidic solution for between approximately 1 minute and approximately 20 minutes. A particularly suitable presoak time is between approximately 5 minutes and approximately 10 minutes. However, as the pH of the acidic solution increases, the effectiveness of the solution to remove starch from starch-soiled articles decreases. Thus, for an acidic solution having a higher pH, the articles must be presoaked in the acidic solution for a longer period of time than for an acidic solution having a lower pH. For example, at a pH of 7, regardless of how long the starch-soiled articles are presoaked in the solution, a significant amount of starchy soils will remain on the surface and in crevices of the articles. In comparison, at a pH of 1.8, starch-soiled articles only need to be presoaked in the acidic solution for approximately five minutes to obtain a significant amount of starchy soil removal.

Examples of suitable acidic solutions include, but are not limited to: phosphoric acid, sulfuric acid, sulfamic acid, methylsulfonic acid, hydrochloric acid, hydrobromic acid, nitric acid, and any combination thereof. Additional examples of suitable acidic solutions are organic acids, including, but not limited to: formic acid, acetic acid, citric acid, and malonic acid.

The second step of the method involves washing the articles in an automatic or manual warewashing process. The washing process typically includes using an alkaline solution. After the starch-soiled articles have been presoaked in the acidic solution for between approximately 1 minute to approximately 10 minutes, depending on the acidic solution used, the articles are then washed in a warewashing process to remove the starch and to further cleanse the soiled articles.

The composition of the alkaline solution includes one or more alkaline carriers. Examples of suitable alkaline carriers include, but are not limited to: hydroxides, alkali silicates, ethanolamines, diethanolamines, monoethanolamines, alkali carbonates, and any combination thereof.

The alkaline solution may also include additional ingredients to further enhance the cleaning step. For example, the alkaline solution may include water conditioning agents, enzymes, enzyme stabilizing systems, surfactants, binding agents, antimicrobial agents, bleaching agents, defoaming agents or inhibitors, dyes, deodorants, carriers, hydrotropes, or any combination thereof.

As shown in the sole FIGURE, starch-soiled articles 10 can be placed into warewashing rack 12 having grip holes 14 and connectable elongated handles 16. Elongated handles 16 allow for easy placement and removal of rack 12 into and from tank 18, which contains the presoak solution. Each of elongated handles 16 includes hook 20 and grip 22. Hooks 20 connect elongated handles 16 to rack 12 at grip holes 14 in rack 12. After placing hooks 20 in grip holes 14, a person holds onto grips 22 of elongated handles 16 while moving rack 12 to and from tank 18. Although the FIGURE depicts elongated handles 16 being connected to rack 12 by hooks 20, elongated handles 16 may be connected to rack 12 by any means known in the art.

In operation, starch-soiled articles 10 are placed in rack 12 and are simultaneously immersed into tank 18 using elongated handles 16 for the requisite amount of time, depending on the strength of the presoak solution. After the appropriate amount of time has elapsed, rack 12 is pulled from tank 18 using elongated handles 16. Starch-soiled articles 10 can thus be submerged in presoak solution without manual handling of starch-soiled articles 10. A person therefore does not need to subject his or her hands to the acidic solution. Additionally, because the racks currently being used in the art already have grips holes for handling, elongated handles 16 may be used with conventional racks without significant modification.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

The following test method was used to characterize the starch removal results in the examples:

Iodine Test for Presence of Starch

The entire surface of articles made from Melamine (Melamine ware) were scratched using #100 sand paper. The sand paper was rubbed on the surface of the articles using manual pressure. Approximately one gram of streamed rice was then spread over the scratched surface of the Melamine ware. The rice was allowed to dry for approximately ten minutes. The starch-soiled Melamine ware was then immersed in an acidic solution for a fixed period of time. After the Melamine ware was removed from the acidic solution, the Melamine ware was washed in a warewashing machine. During warewashing, the Melamine ware was subjected to a tank temperature of approximately 65 degrees Celsius (° C.) and a final rinse temperature of approximately 86° C. Approximately 0.2% w/w Solid Super Impact®, a warewashing detergent, was added to the warewashing machine during the wash cycle. The Melamine ware was washed for 45 seconds, and then rinsed for 11 seconds. The Melamine ware was then cooled down with water before being immersed in a Mikroklene® iodine solution to check for remaining starch levels on the Melamine ware.

Materials Used

Solid Super Impact®: a warewashing detergent, available from Ecolab Incorporated, Saint Paul, Minn.

Mikroklene®: an iodine solution, available from Ecolab Incorporated, Shika, Ishikawa-ken, Japan.

Lime-A-Way®: an acidic cleaning solution, available from Ecolab, Incorporated, Noda-Shi, Chiba-ken, Japan.

X-Streamtec Shine PF®: an acidic cleaning solution, available from Ecolab GmbH & Company, OHG, Germany.

Examples 1, 2, 3, 4, 5, and 6 and Comparative Example A

Examples 1, 2, 3, 4, 5, and 6 used an acidic solution to presoak starch-soiled articles. The acidic solutions of Examples 1, 2, and 3 had a pH of about 1.8 and contained X-Streamtech Shine PF at a concentration of 1%. The acidic solution of Example 4 had a pH of about 0.73 and contained X-Streamtech Shine PF at a concentration of 9.85%. The acidic solution of Example 5 had a pH of about 1.8 and contained Lime-A-Way at a concentration of 0.89%. Example 6 had a pH of about 2.8 and contained Lime-A-Way at a concentration of 0.067%. Comparative Example A used only water to presoak the starch-soiled articles.

Five samples of starch-soiled articles were placed in each of the acidic solution baths and the control water bath, respectively for varying amounts of time and at varying temperatures.

Table 1 provides the solution used during presoaking, the pH of the presoak solution, the temperature of the presoak solution, the presoak time, and the cleanliness of the articles after being presoaked in the solution, as analyzed pursuant to the method discussed above, for compositions of Examples 1, 2, 3, 4, 5, and 6 and Comparative Example A. Numerical rating values between 1 and 5 are based on a sliding scale. A cleanliness rating of 1 indicates a very clean sample with minimal starch deposits. A cleanliness rating of 5 indicates a dirty sample with large amount of starch deposits.

TABLE 1

| | Presoak Solution | pH | Temperature, ° C. | Time, min | Average cleanliness |
|---|---|---|---|---|---|
| Example 1 | 1% X-Streamtec Shine PF | 1.8 | 18 | 5 | 2.0 |
| Example 2 | 1% X-Streamtec Shine PF | 1.8 | 18 | 10 | 2.2 |
| Example 3 | 1% X-Streamtec Shine PF | 1.8 | 43 | 10 | 1.4 |
| Example 4 | 9.85% X-Streamtec Shine PF | 0.73 | 43 | 5 | 2.0 |
| Example 5 | 0.89% Lime-A-Way | 1.8 | 43 | 5 | 3.0 |
| Example 6 | 0.067% Lime-A-Way | 2.8 | 43 | 5 | 4.0 |
| Comparative Example A | Water | 7 | 43 | 5 | 4.6 |

Example 1 presoaked the starch-soiled articles at a temperature of 18° C. for five minutes and had an average cleanliness rating of 2. Example 2 presoaked the starch-soiled articles at a temperature of 18° C. for ten minutes and had an average cleanliness rating of 2.2. Example 3 presoaked the starch-soiled articles at a temperature of 43° C. for ten minutes and had an average cleanliness rating of 1.4. Examples 1-3 all had a pH of approximately 1.8. The starch-soiled articles of Example 4 were presoaked in an acidic solution having a pH of approximately 0.73 at a temperature of 43° C. for five minutes. The average cleanliness rating for the starch-soiled articles presoaked with the composition of Example 4 was 2.0. The starch-soiled articles of Example 5 were presoaked in an acidic solution having a pH of approximately 1.8 at a temperature of 43° C. for five minutes. The average cleanliness rating for the starch-soiled articles presoaked with the composition of Example 5 was 3.0. The starch-soiled articles of Example 6 were presoaked in an acidic solution having a pH of approximately 2.8 at a temperature of 43° C. for five minutes. The average cleanliness rating for the starch-soiled articles presoaked with the composition of Example 6 was 4.0.

By contrast, Comparative Example A used only a water solution with a pH of 7 to presoak starch-soiled articles. Comparative Example A had a cleanliness rating of 4.6. The starch-soiled articles of Comparative Example A were presoaked at a temperature of 43° C. for five minutes.

The effectiveness of an acidic solution is generally dependent on three factors: pH, temperature, and presoak time. As can be seen in Table 1, more starch was removed from the starch-soiled articles when the articles were presoaked in an acidic solution. Typically, the more acidic the solution, (solutions with a lower pH), the better the starch removal. The starch-soiled articles were soaked in the acidic solutions of Examples 4, 5, and 6 at the same temperature for the same amount of time, with only the pH of the solutions as a variable. For example, the pH varied from 0.73 for Example 4 to 1.8 for Example 5 to 2.8 for Example 6. As can be seen in Table 1, as the pH of the acidic presoak solution decreased, the cleanliness rating of the starch-soiled articles improved. This is further portrayed when starch-soiled articles were washed with water, which had a pH of 7. The cleanliness rating of the starch-soiled articles presoaked in the water solution in Comparative Example A at the same temperature and for the same amount of time was 4.6

The temperature at which the starch-soiled articles were presoaked in the acidic solution also affected the amount of starch removed from the surface and crevices of the starch-soiled articles. Starch-soiled articles of Examples 2 and 3 were soaked in an acidic solution for the same amount of time and at the same pH and concentration. The only difference was the presoak temperature of the acidic solutions. As can be seen in Table 1, as the presoak temperature increased from 18° C. to 43° C. for Example 2 and Example 3, the cleanliness ratings improved from about 2.2 to about 1.4.

The amount of time the starch-soiled articles were presoaked in the acidic solution did not affect the level of starch removal from the surface and crevices of the starch-soiled articles as significantly as the temperature of the presoak. Starch-soiled articles of Examples 1 and 2 were soaked at the same temperature in acidic solutions having the same pH and concentration. The only difference was the amount of time the starch-soiled articles were soaked in the acidic solutions. As can be seen in Table 1, as the presoak time increased from 5 minutes to 10 minutes for Example 1 and Example 2, the difference in the amount of starch deposits on the starch-soiled articles was negligible, with a cleanliness rating of around 2.

Starch-soiled articles that are presoaked in an acidic solution exhibit improved starch removal from the surface and crevices of the articles. Three factors typically control the cleanliness level of starch-soiled articles presoaked in an acidic solution: pH, temperature, and presoak time. As the pH of the acidic solution decreases, the level of cleanliness of the presoaked starch-soiled articles also increases. Additionally, when the starch-soiled articles are presoaked at higher temperatures, the cleanliness level of the starch-soiled articles increases. Also, as the amount of time the starch-soiled articles are in contact with the presoak solution increases, the cleanliness of the articles also increases, although this increase may be negligible at lower pH levels. Thus, process times for effective starch removal can be lowered using a combination of an acidic solution presoak and alkaline solution wash method at appropriate temperatures and presoak times.

Although the present invention has been described with reference to preferred embodiments, workers skilled in the art will recognize that changes may be made in form and detail without departing from the spirit and scope of the invention.

The invention claimed is:

1. A method of removing starch from a surface of an article of ware, the method consisting of:

(a) in a first step, placing the article in a warewashing rack system and, presoaking the article in the rack system in an acidic solution by manually immersing the rack system in a tank containing the acidic solution for between approximately 1 minute and approximately 20 minutes to degrade and to remove starch from the surface of the article without scrubbing, wherein the acidic solution comprises at least one of the group consisting of phosphoric acid, sulfuric acid, sulfamic acid, methylsulfonic acid, hydrochloric acid, hydrobromic acid, nitric acid and an organic acid;

(b) manually removing the rack system from the tank; and thereafter (c) cleaning the article in the rack system comprising placing the rack system in an automatic warewashing machine and performing an automatic warewashing process using an alkaline solution to cleanse the article and remove remaining starch from the surface of the article.

2. The method of claim 1, wherein the acidic solution has a pH range of between approximately 0 and approximately 4.

3. The method of claim 1, wherein presoaking the article of ware comprises soaking the article of ware in the acidic solution for between approximately 5 minutes and approximately 10 minutes.

4. The method of claim 1, wherein the article of ware is formed from melamine, ceramic, or metal.

5. The method of claim 1, wherein the alkaline solution is a hydroxide.

6. The method of claim 1, wherein the warewashing rack system comprises:

(a) a rack having a plurality of holes; and (b) a plurality of elongated handles having grips and connectable to the warewashing rack system, further comprising connecting the elongated handles to the rack; holding the grips; and manually moving the rack to and from the tank without a person contacting the acidic solution.

7. The method of claim 2, wherein the acidic solution has a pH of between approximately 1 and approximately 3.

* * * * *